US006978514B2

(12) United States Patent
Kuo et al.

(10) Patent No.: US 6,978,514 B2
(45) Date of Patent: Dec. 27, 2005

(54) RETRACTABLE HANDLE OF WHEELED LUGGAGE HAVING ONE OR TWO PULLING RODS

(75) Inventors: Chung-Hsien Kuo, Pan-Chiao (TW); Hui Ming Wang, Taipei (TW)

(73) Assignee: Chaw Khong Technology Co., Ltd., Wu Ku Hsiang (TW)

( * ) Notice: Subject to any disclaimer, the term of this patent is extended or adjusted under 35 U.S.C. 154(b) by 64 days.

(21) Appl. No.: 10/805,298

(22) Filed: Mar. 22, 2004

(65) Prior Publication Data

US 2004/0181906 A1 Sep. 23, 2004

(51) Int. Cl.[7] ..... B62B 7/00

(52) U.S. Cl. ..... 16/113.1; 16/429; 280/655; 190/115; 190/18 A; 190/39

(58) Field of Search ..... 16/113.1, 429, 16/430, 411; 280/655; 190/115, 18 A, 39

(56) References Cited

U.S. PATENT DOCUMENTS 5,581,847 A * 12/1996 Hsieh ..... 16/113.1
5,813,504 A * 9/1998 Iny et al. ..... 190/116
5,836,052 A * 11/1998 Chou ..... 16/405
6,122,800 A * 9/2000 Cheng ..... 16/113.1
6,148,477 A * 11/2000 Cheng ..... 16/113.1
6,434,790 B1 * 8/2002 Chen ..... 16/113.1
6,564,426 B1 * 5/2003 Wang ..... 16/113.1
6,591,951 B1 * 7/2003 Chen ..... 190/115
6,651,791 B1 * 11/2003 Nykoluk et al. ..... 190/18 A
D486,647 S * 2/2004 Nordstrom et al. ..... D3/318
6,857,511 B2 * 2/2005 Lin et al. ..... 190/115
6,892,866 B2 * 5/2005 Wu ..... 190/115

* cited by examiner

*Primary Examiner*—Suzanne Dino Barrett
*Assistant Examiner*—Mark Williams

(57) ABSTRACT

A retractable handle of wheeled luggage is provided. For the case of single pulling rod, pressing a push button will tighten a connecting rod to move a lower sliding block to a one direction so that an upright rod is pressed to lower a locking member and an upright member to clear the locking member from a toothed member, thereby unlocking both the swivel handle grip and the pulling rod. For the case of two pulling rods, there is further provided another transmission mechanism so that pressing the push button will further unlock locking devices in the pulling rods via coupling rods.

15 Claims, 11 Drawing Sheets

RETRACTABLE HANDLE OF WHEELED LUGGAGE HAVING ONE OR TWO PULLING RODS

BACKGROUND OF THE INVENTION

1. Field of The Invention

The present invention relates to retractable handle of a wheeled luggage case and more particularly to such a handle having one or two pulling rods each having a handle grip in the shape of enclosed frame (e.g., rectangle).

2. Description of Related Art

Conventionally, a retractable handle of a wheeled luggage case having a single pulling rod has a shape of T (i.e., T-shaped handle grip) disclosed in U.S. Pat. No. 6,434,790. For maintaining structural strength of the handle, the single pulling rod typically has a diameter at least two times larger than that of pulling rod of the popular n-shaped handle. As such, such can adversely affect a degree of comfort while holding the handle in towing luggage because the fingers are extended discomfortably.

A rectangular handle grip proposed to eliminate the above problem associated with T-shaped handle grip is disclosed in U.S. Pat. No. 6,148,477. However, the prior art suffered from several disadvantages. For example, there is no provision of swivel mechanism on the handle grip (i.e., no rotation on a horizontal plane is provided), resulting in a discomfortable holding thereof by the hand. Further, the handle interconnected the push button and the locking device is not devised well. Hence, a need for improvement exists.

SUMMARY OF THE INVENTION

It is an object of the present invention to provide a retractable handle of a wheeled luggage comprising a pulling rod including one or more sliding tubes and a support tube; and a swivel handle grip mounted on a top of the pulling rod and comprising an enclosed frame including a top recessed seat, a horizontal passage, first and second openings on a bottom of the seat, a top third opening on the seat, a bottom recess, and a bottom tunnel on the bottom recess; and a first transmission mechanism comprising a push button slidably anchored in the third opening, the push button including a spring biased first bottom post having a slanted end passed the first opening and a second bottom post having a slanted end passed the second opening, an upper sliding block disposed in the passage and including a first compartment, a second compartment having a slanted surface with the slanted end of the first bottom post disposed thereon, and a third compartment having a slanted surface with the slanted end of the second bottom post disposed thereon, a flexible connecting rod having one end fastened at the first compartment, a spring biased lower sliding block disposed in the bottom recess and including a left cavity with the other end of the connecting rod fastened therein and a bottom dent, a central sleeve extended downward from a bottom of the frame of the handle grip, the sleeve having an intermediate neck and a lower annular toothed member having a plurality of slots therearound, an upright rod slidably received in the bore of the sleeve, the upright rod having a sharp top end passed the bottom tunnel to urge against the dent, a locking member engaged with two opposite ones of the slots and a bottom of the upright rod, a spring biased upright member engaged with a bottom of the locking member, and a sheath interconnecting the sleeve and the upper sliding tube for enclosing the neck, the toothed member, the upright rod, the locking member, and the upright member; whereby pressing the push button will lower the first and the second posts to push the slanted surfaces rightwards for moving one end of the connecting rod to move to the right and the lower sliding block to move to the left so that the top end of the upright rod is pressed by the dent to cause the upright rod, the locking member, and the upright member to move down to clear the locking member from the slots of the toothed member, thereby unlocking both the handle grip and the pulling rod.

It is another object of the present invention to provide a retractable handle of a wheeled luggage, comprising a pair of pulling rods each including one or more sliding tubes and a support tube; and a swivel handle grip mounted on a top of the pulling rod and comprising an enclosed frame including a top recessed seat, a horizontal passage, first and second openings on a bottom of the seat, a top third opening on the seat, a bottom recess, and a bottom tunnel on the bottom recess; a first transmission mechanism comprising a push button slidably anchored in the third opening, the push button including a spring biased first bottom post having a slanted end passed the first opening and a second bottom post having a slanted end passed the second opening, an upper sliding block disposed in the passage and including a first compartment, a second compartment having a slanted surface with the slanted end of the first bottom post disposed thereon, and a third compartment having a slanted surface with the slanted end of the second bottom post disposed thereon, a flexible connecting rod having one end fastened at the first compartment, a spring biased lower sliding block disposed in the bottom recess and including a left cavity with the other end of the connecting rod fastened therein and a bottom dent, a central sleeve extended downward from a bottom of the frame of the handle grip, the sleeve having an intermediate neck and a lower annular toothed member having a plurality of first slots therearound, and an upright rod slidably received in the bore of the sleeve, the upright rod having a sharp top end passed the bottom tunnel to urge against the dent; and a second transmission mechanism comprising a housing including a longitudinal cylinder including a top flange, a narrow shoulder below the flange for slidably receiving the neck, a space below the shoulder for slidably receiving the toothed member, a transverse passageway through the space, and a bottom cavity; and an activation assembly received in the housing and comprising an inverted U-shaped locking member disposed in the passageway to be engaged with two opposite ones of the first slots and a bottom of the upright rod, the locking member including a lower central post and two lower side posts, a U-shaped seat including an upper groove, a spring biased lower post anchored on the bottom cavity for pushing the seat upward, and a channel through the lower post with the central post disposed therein, a pair of levers pivotably disposed in the housing, each lever including a well at one end for receiving the side post and a second slot at the other end, and a pair of flexible coupling rods each having one end fastened at the second slot and the other end coupled to a locking device in either pulling rod, whereby pressing the push button will lower the first and the second posts to push the slanted surfaces rightwards for moving one end of the connecting rod to move to the right and the lower sliding block to move to the left so that the top end of the upright rod is pressed by the dent to lower the upright rod, the locking member, and the seat for pushing down the wells and lifting the second slots, thereby unlocking both the handle grip and the locking devices in the pulling rods via the coupling rods.

In one aspect of the present invention the handle grip is a rectangle.

In another aspect of the present invention there is further provided a hose member sleeved on the connecting rod.

The above and other objects, features and advantages of the present invention will become apparent from the following detailed description taken with the accompanying drawings.

DETAILED DESCRIPTION OF THE PREFERRED EMBODIMENTS

Figure 1:
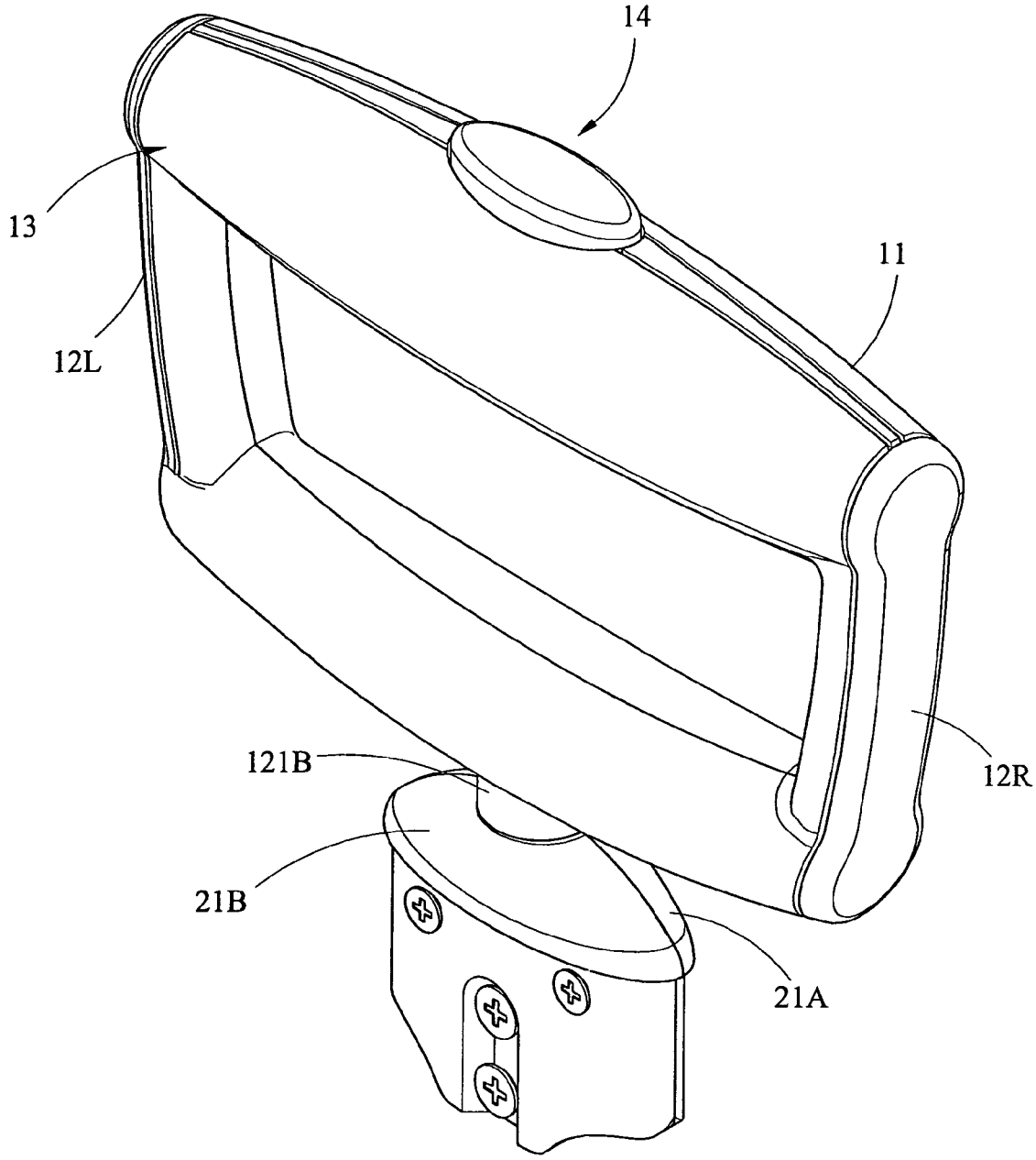
FIG. 1 is a perspective view of a first preferred embodiment of rectangular handle grip mountable on a single pulling rod of a retractable handle of wheeled luggage case according to the invention.
Figure 2:
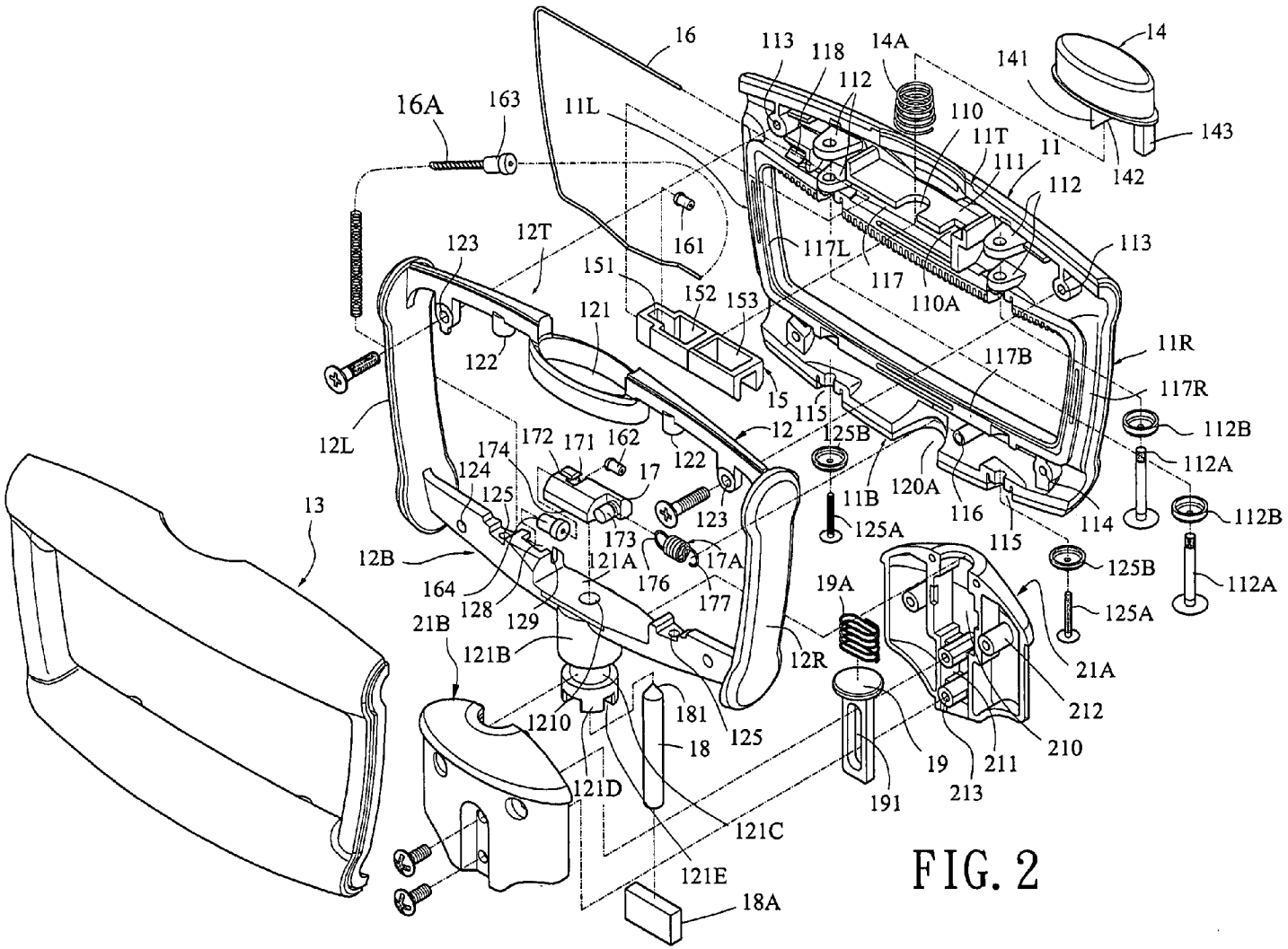
FIG. 2 is an exploded view of the handle grip in FIG. 1.
Figure 3:
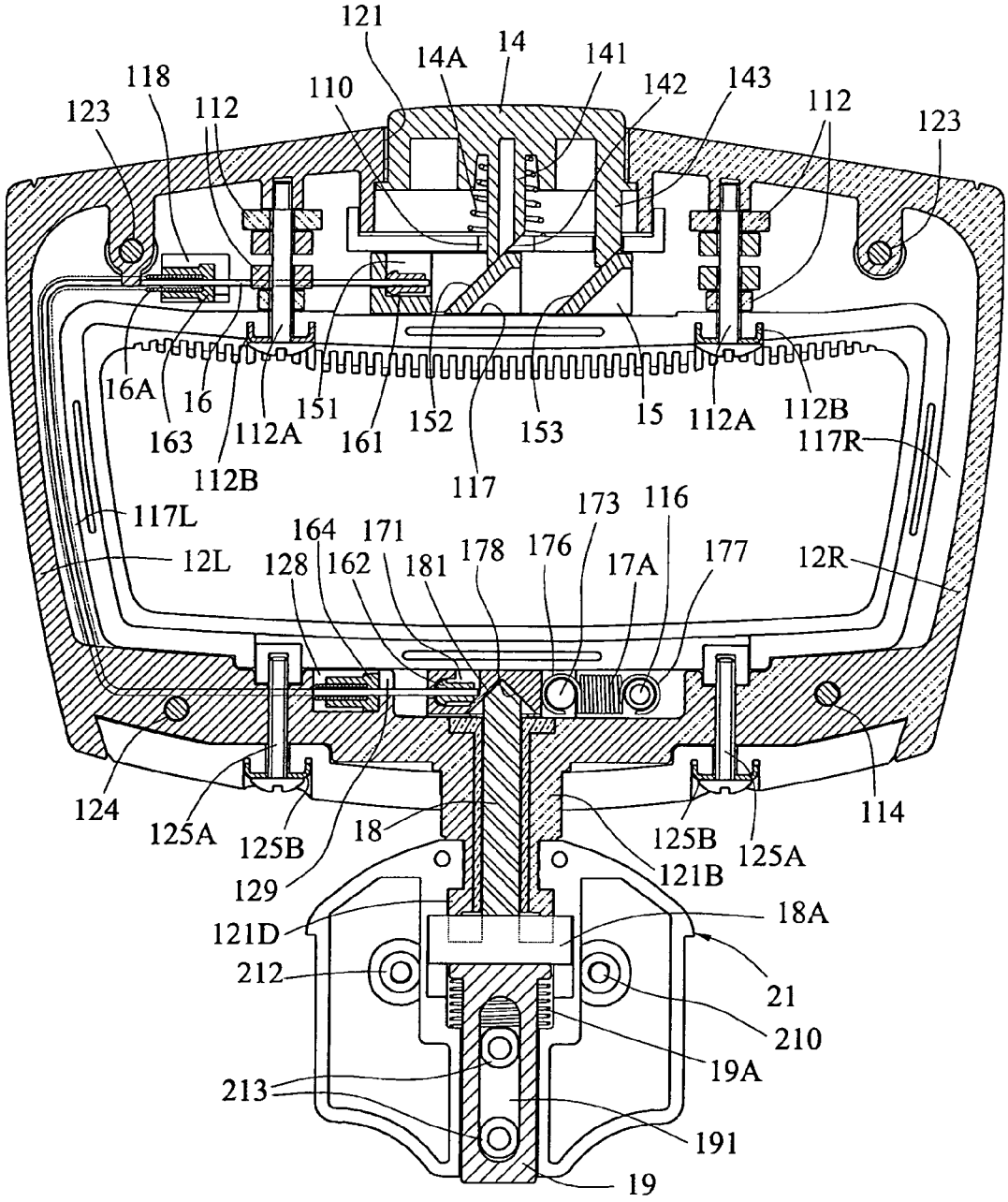
FIG. 3 is a sectional view of the handle grip in FIG. 1, where the push button is in a nonoperating position.
Figure 4:
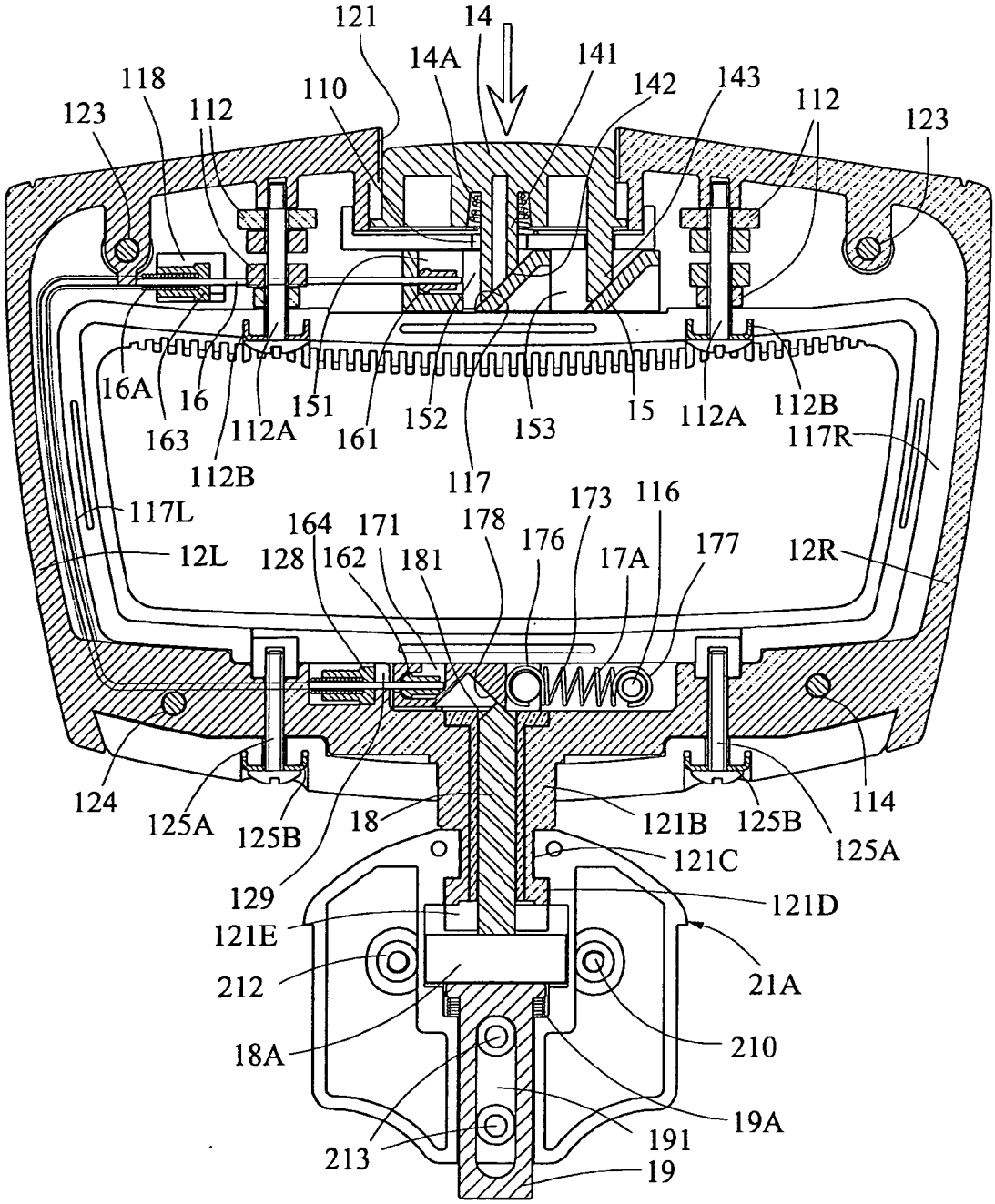
FIG. 4 is a view similar to FIG. 3, where the push button is in an operating position.
Figure 5:
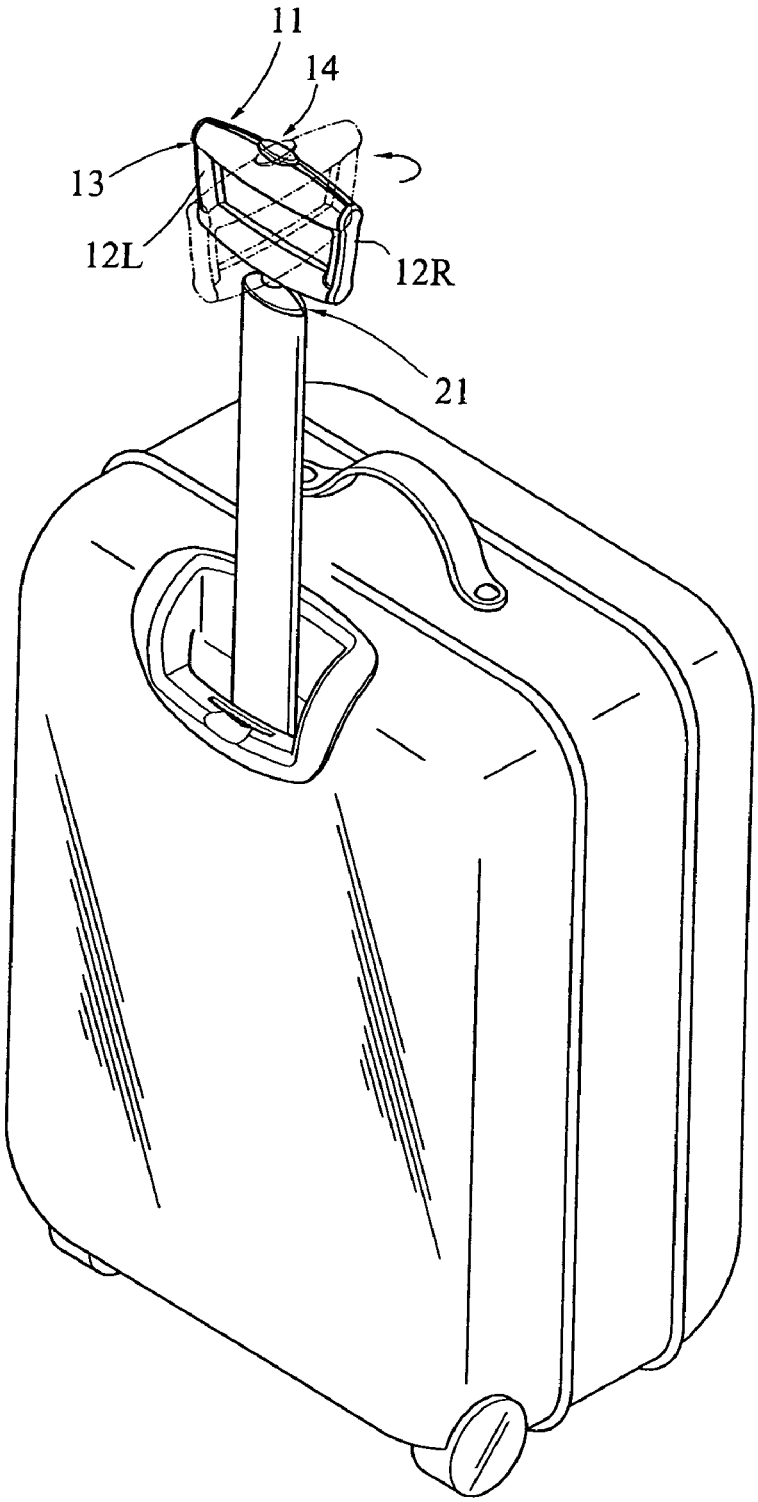
FIG. 5 is a perspective view of a wheeled luggage case incorporating the handle grip on a single pulling rod of retractable handle in FIG. 1.
Figure 6:
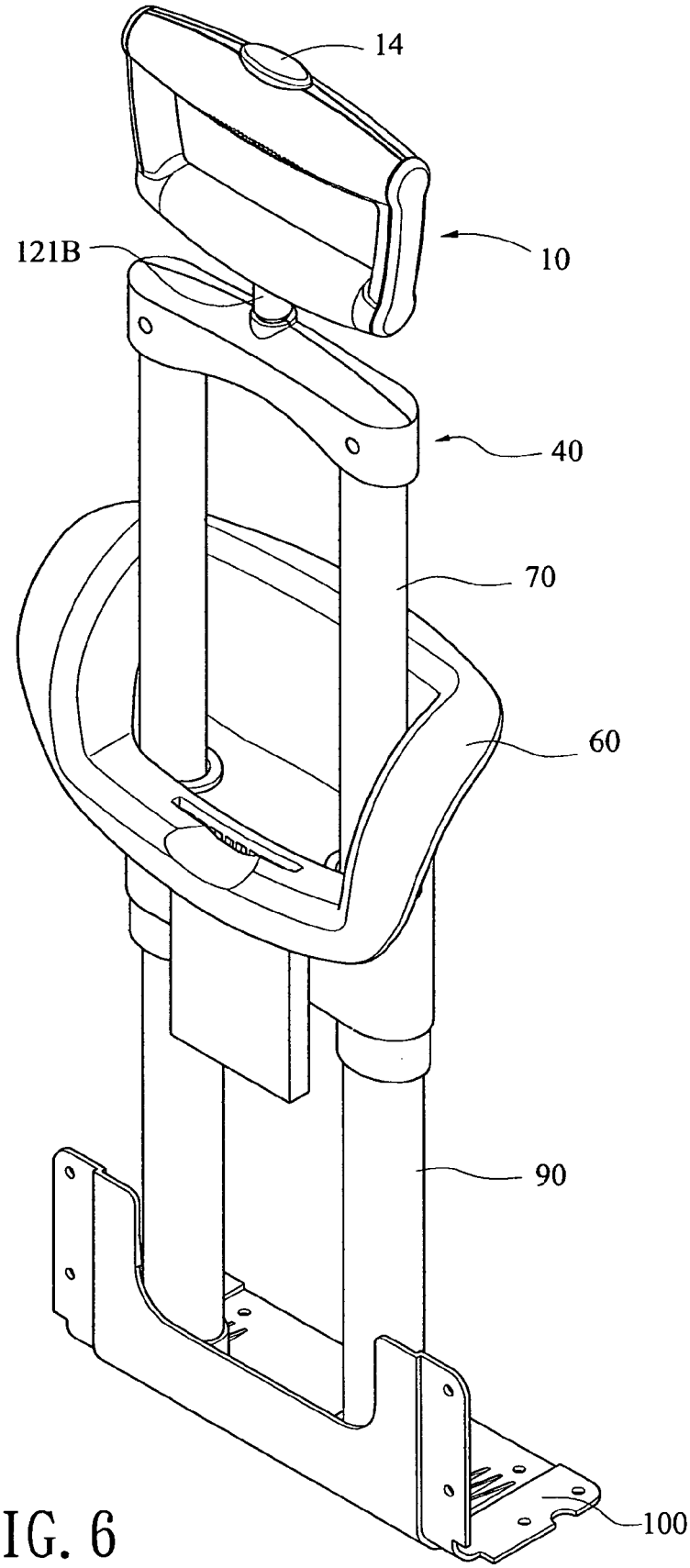
FIG. 6 is a perspective view of a retractable handle of wheeled luggage case having two adjacent pulling rods with a second preferred embodiment of handle grip mounted thereon according to the invention.
Figure 7:
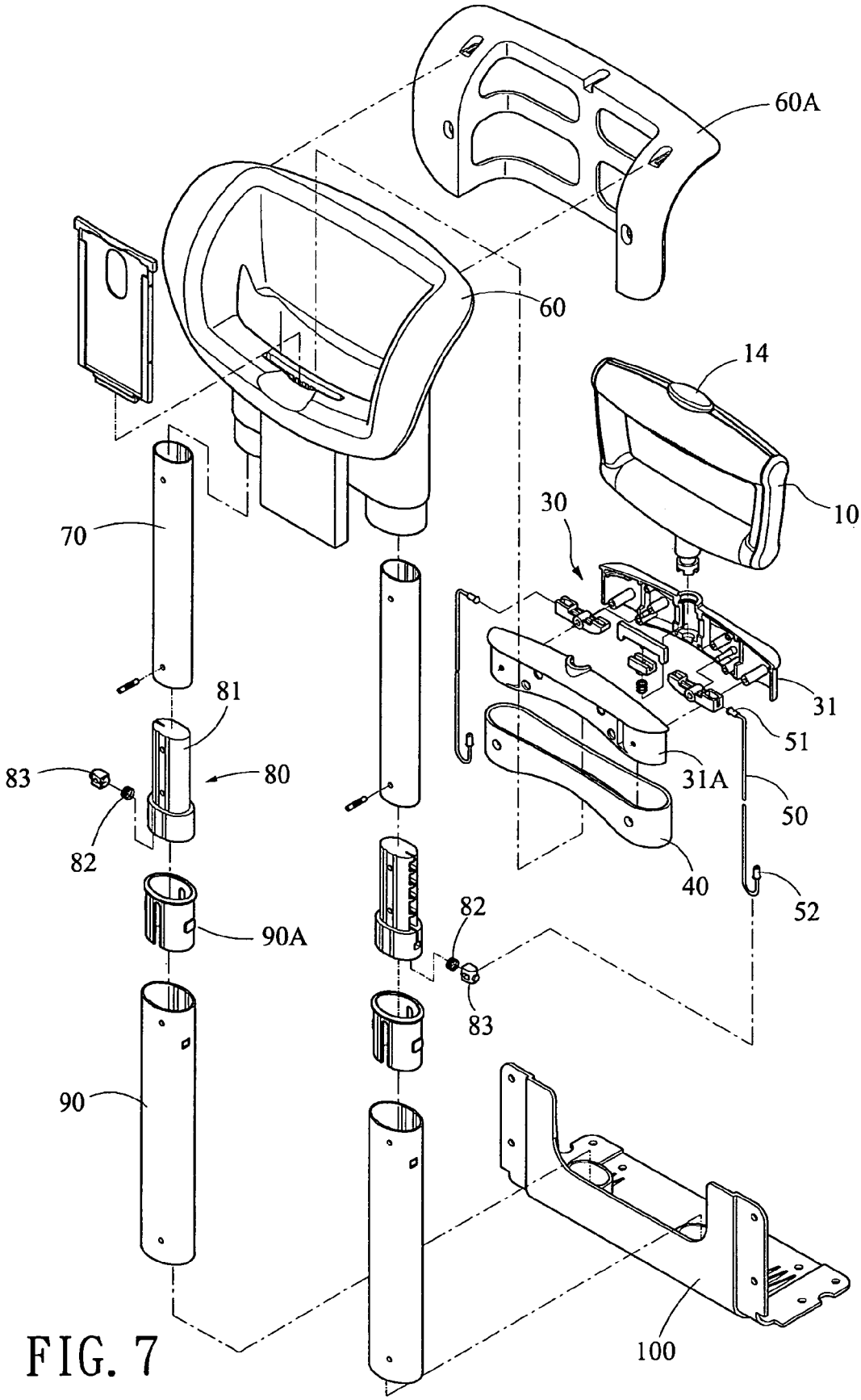
FIG. 7 is an exploded view of the handle in FIG. 6.
Figure 8:
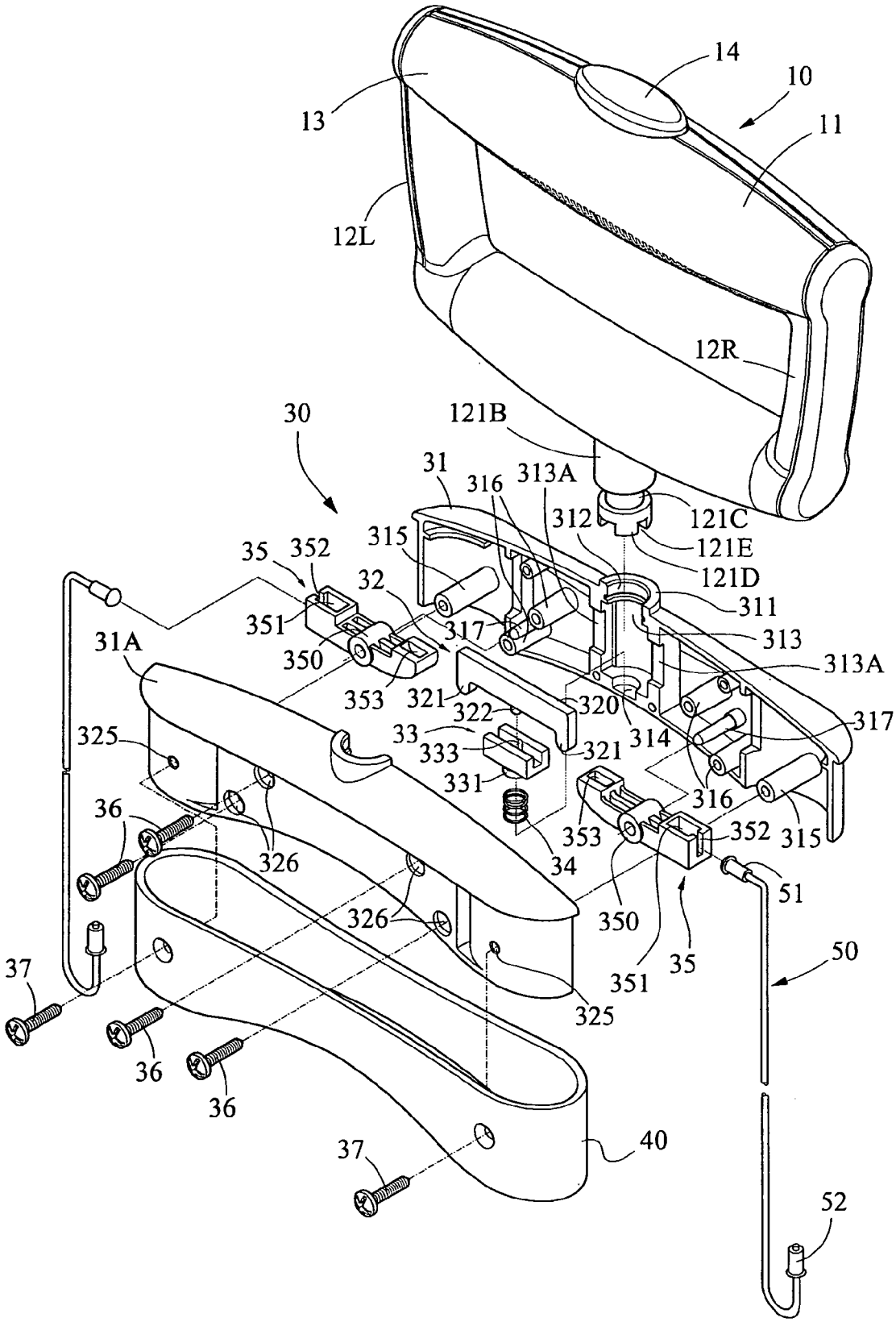
FIG. 8 is an enlarged detailed view of a portion of the handle in FIG. 7.

Referring to FIGS. 1 to 5, a retractable handle of wheeled luggage constructed in accordance with a first preferred embodiment of the invention is shown. A handle grip, mounted on a single pulling rod of the handle, comprises a right frame element 11, a central frame element 12, a left frame element 13, a push button 14 including a central post 141 having a slanted end at the bottom and a side post 143 having a slanted end at the bottom, the push button 14 provided on the central frame element 12, a first spring 14A put on the central post 141, an upper sliding block 15 laterally moveable in a distance along top edges of both the right and the left frame elements 11 and 13, a flexible connecting rod 16 extended from the upper sliding block 15 to the lower sliding block 17 via left portions of the right and the left frame elements 11 and 13, a lower sliding block 17 including a left cavity 171 with a second head 162 of the connecting rod 16 fastened therein, a short passage 172 with the second head 162 passed, a dent 178 at central portion of bottom, and a right pin 173, a second spring 17A having one end 176 anchored at the pin 173 and the other end 177 anchored in a pin 116 at the bottom 11B of the right frame element 11, an upright rod 18 having a sharp top end 181 in a central sleeve 121B under the bottom of the central frame element 12, a locking element 18A engaged with a bottom of the upright rod 18, a sliding upright member 19 engaged with a bottom of the locking element 18A, a third spring 19A put on the sliding upright member 19, and a sheath 21 put on the central sleeve 121B. The sheath 21 consists of two symmetric parts 21A and 21B. each (e.g., part 21A) having a wide central well 210 for receiving the sleeve 121B and the locking element 18A, a narrow central well 211 for receiving the sliding upright member 19 and the third spring 19A, two inner threaded pins 212 at both sides of the central well 210 for fastening parts 21A and 21B of the sheath 21 together by driving screws therein, and two inner threaded pins 213 at upper and lower ends of the central well 211 for fastening a sliding tube (not shown) and the sheath 21 together by driving screws therein. Note that the right frame element 11 is symmetric in shape with respect to the left frame element 13 so that description of the right frame element 11 serves to describe the entirety. As shown in FIG. 2, the rectangular right frame element 11 comprises a top 11T, a bottom 11B, a left portion 11L, and a right portion 11R. The top 11T comprises a recessed seat 111 with the push button 14 disposed therein, a central opening 110 on the seat 111, a right opening 110A, upper and lower holed lugs 112 at either side of the seat 111, an inner threaded pin 113 adjacent either end of the top 11T, and a horizontal passage 117 under the seat 111 with the upper sliding block 15 provided therein. The passage 117 together with the groove 117L of the left portion 11L, the groove 117R of the right portion 11R, and the groove 117B of the bottom 11B form an enclosed groove in the shape of rectangle. A substantially half circular recess 120A is formed in the central part of the bottom 11B. Two recesses 120A are adapted to enclose the sleeve 121B. An aperture 115 is provided at either side of the recess 120A. An inner threaded pin 114 is provided adjacent either end of the bottom 11B.

The central frame element 12 comprises a top 12T, a bottom 12B, a left portion 12L, and a right portion 12R. The top 12T comprises an oval opening 121 with the push button 14 slidably received therein, two arms extended laterally each having an inner threaded post 122 extended downward, the inner threaded post 122 being adapted to sandwich between the lugs 112, and two inner threaded lugs 123 either adjacent end. The inner threaded lug 123 is aligned with the inner threaded pin 113. As such, the right, the central, and the left frame elements 11, 12 and 13 can be fastened together by driving screws through the inner threaded pins 113 and the inner threaded lugs 123. The bottom 12B comprises a flat 121A, a sleeve 121B under the flat 121A, a neck 121C under the sleeve 121B, and an annular toothed member 121D having a plurality of slots 121E therearound, two opposite slots 121E being adapted to engage with the locking element 18A. A hole 1210 is extended from the flat 121A to the toothed member 121D through the sleeve 121B. A first compartment 128 is provided at one side of the flat 121A. A dent 129 is formed between the first compartment 128 and the flat 121A. As shown in FIG. 2, one indentation 125 is formed at right side of the flat 121A and another indentation 125 is formed at left side of the first compartment 128. A hole 124 is provided adjacent either end of the bottom 12B. The indentations 125 and the holes 124 are aligned with the apertures 115 and the inner threaded pins 114 respectively.

The upper sliding block 15 is slidable along the passage 117 and comprises a second compartment 151 with a first head 161 of the connecting rod 16 anchored therein, a third compartment having a slanted surface 152, and a fourth compartment having a slanted surface 153. A hose member 16A has one enlarged end 163 anchored in a fifth compartment 118 adjacent one end of the top 11T, and the other enlarged end 164 anchored in the first compartment 128. The connecting rod 16 is adapted to pass the hose member 16A with the first head 161 of the connecting rod 16 extended from the enlarged end 163 to anchor in the second compartment 151. Also, the second head 162 of the connecting rod 16 is extended from the enlarged end 164 to anchor in the cavity 171. The provision of the hose member 16A can facilitate the connecting rod 16 to pull smoothly when the push button 14 is pressed as detailed later.

An assembly of the invention will now be described in detail below. Assemble the right and the central frame elements 11 and 12 together. In detail, place the upper sliding block 15 in the passage 117. Put the first spring 14A on the post 141. Put the opening 121 on the push button 14. Insert the upright rod 18 into the hole 1210. Anchor the enlarged end 163 of the hose member 16A in the fifth compartment 118. Anchor the first head 161 of the connecting rod 16 in the second compartment 151. Anchor the other enlarged end 164 of the hose member 16A in the first compartment 128. Anchor the second head 162 of the connecting rod 16 in the cavity 171. Anchor one end 176 of the second spring 17A at the pin 173 and the other end 177 thereof at the pin 116. The dent 178 is urged by the sharp top end 181 of the upright rod 18. Drive screws through the inner threaded lugs 123 and the holes 124 into the inner threaded pins 113 and inner threaded pins 114 respectively for fastening the central and the right frame elements 12 and 11 together. Snap the left frame element 13 onto the left portion 12L and the right portion 12R. Drive screws 112A through U-shaped washers 112B into the lugs 112 for fastening the right and the left frame elements 11 and 13 together. Drive screws 125A through U-shaped washers 125B into the apertures 115 and the indentations 125 for further fastening the right and the left frame elements 11 and 13 together. Place the locking element 18A, the sliding upright member 19, and the third spring 19A into the sheath 21 under the sleeve 121B. Finally, drive screws into the inner threaded pins 213 for fastening two parts 21A and 21B together.

An operation of the invention will now be described in detail below. Press the push button 14 to compress the first spring 14A. The posts 141 and 143 are lowered to contact and push the slanted surfaces 152 and 153 of the upper sliding block 15 rightwards. That is, the block 15 moves rightwards from the position in FIG. 3 to the position in FIG. 4. The first head 161 moves to the right and the second head 162 (i.e., the lower sliding block 17) moves to the left respectively. As a result, the top end 181 is pressed by the dent 178 to force the upright rod 18 to move down. Next, both the locking element 18A and the sliding upright member 19 move down to clear the locking element 18A from the slots 121E of the toothed member 121D. As a result, not only the locking device underneath is unlocked (i.e., a sliding of the pulling rod is made possible) but also a swivel of the handle grip is possible (see FIG. 5).

Note that the central frame element 12 can be integrally formed with either the right frame element 11 or the left frame element 13 prior to threadedly securing the right frame element 11 to the left frame element 13. Further, the right frame element 11, the central frame element 12, and the left frame element 13 can be replaced by two symmetrical parts (e.g., right frame element 11 and left frame element 13) with components of the central frame element 12 being incorporated in the right frame element 11 and the left frame element 13. These embodiments are also possible.

Referring to FIGS. 6 to 11, a retractable handle of wheeled luggage constructed in accordance with a second preferred embodiment of the invention is shown. The handle comprises two pulling rods, a rectangular handle grip 10 having a first transmission mechanism containing the above components 14 to 18, a second transmission mechanism 30 under the first transmission mechanism, an elongate container 40 for holding the second transmission mechanism 30 together, a pair of connecting rods 50, a bezel 60 having a conformed outer member 60A, a pair of sliding tubes 70, a pair of locking devices 80 provided at bottoms of the sliding tubes 70, a pair of support tubes 90 for receiving the sliding tubes 70 therein, a pair of sleeves 90A provided on tops of the support tubes 90, and an L-shaped support 100 provided at bottoms of the support tubes 90. Components (e.g., the handle grip 10 and elements (e.g., the lower sliding block 17, the connecting rod 16, the spring 17A, the sleeve 121B, and the upright rod 18) within the first transmission mechanism) are not described further since they have been described in the first preferred embodiment. Further, components such as the bezel 60, the outer member 60A, the sliding tubes 70, the locking devices 80 each containing a locking housing 81, a locking spring 82, and a locking block 83, the support tubes 90, the sleeves 90A, and the support 100 are well known. Thus a detailed description thereof is omitted herein for the sake of brevity.

The characteristics of the second preferred embodiment are detailed below by referring to FIGS. 7 to 10 specifically. In response to pressing the push button 14, the second transmission mechanism 30 is adapted to transmit a downward force from the upright rod 18 to the left and right locking devices 80 for unlocking.

The transverse second transmission mechanism 30 is enclosed in a housing consisting of two symmetrical parts 31 and 31A so that description of one side (e.g., part 31) serves to describe the entirety. Distinct elements enclosed by the parts 31 and 31A comprise an inverted U-shaped locking member 32 under the upright rod 18, the locking member 32 including an elongate member 320, a lower central post 322, and two lower side posts 321, a seat 33 having a section of U, the seat 33 including an upper groove 333, a lower post 331, and a central channel 334 through the post 331, a spring 34 biased against a bottom of the post 331, a pair of levers 35 each including a tubelike element 350 with a pin 317 on an inner surface of the part 31 pivotably received therein, a well 353 at an inner end for receiving the side post 321, a slot 351 at an outer end of the lever 35, and a dent 352 at an outer wall of the slot 351 so that one enlarged end 51 of a connecting rod 50 can be anchored in the slot 351 by resting on the dent 352. The other end 52 of the connecting rod 50 is connected to a slidable locking block 83 (see FIG. 7) of the locking device 80 by passing the sliding tube 70 in a well known technique.

Figure 9:
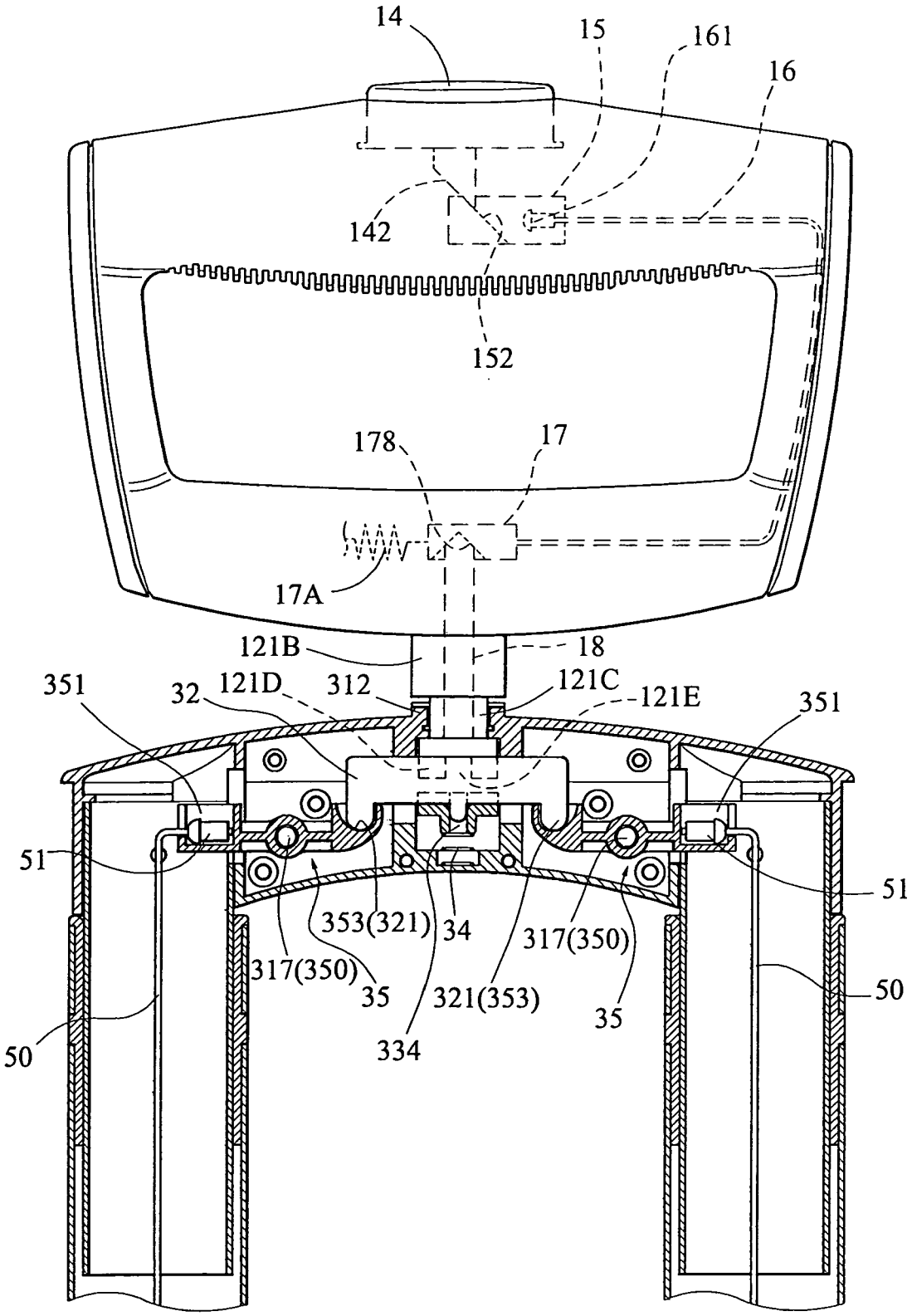
FIG. 9 is a sectional view of top portion of the handle grip in FIG. 6, where the push button is in a nonoperating position.
Figure 10:
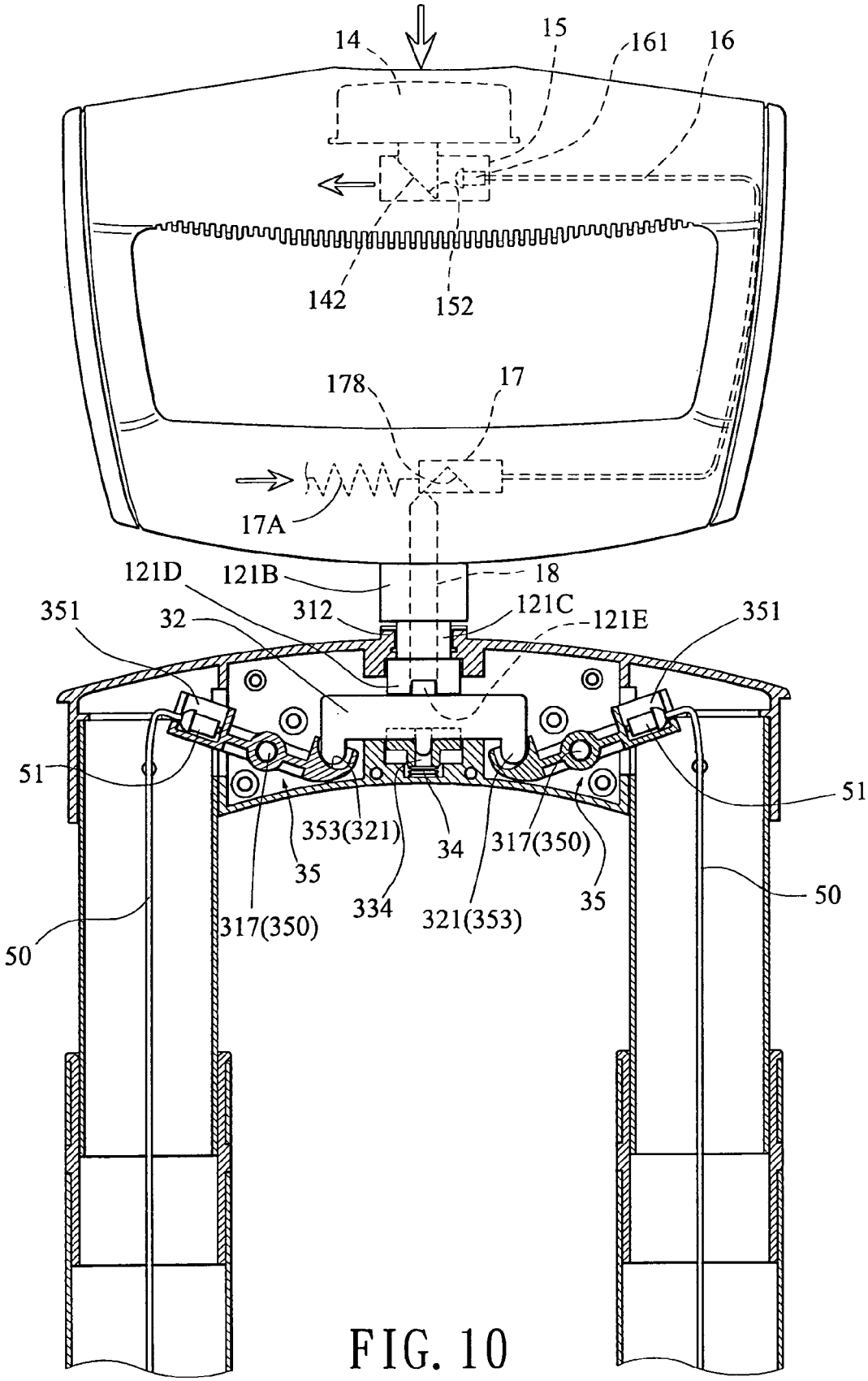
FIG. 10 is a view similar to FIG. 9, where the push button is in an operating position.
Figure 11:
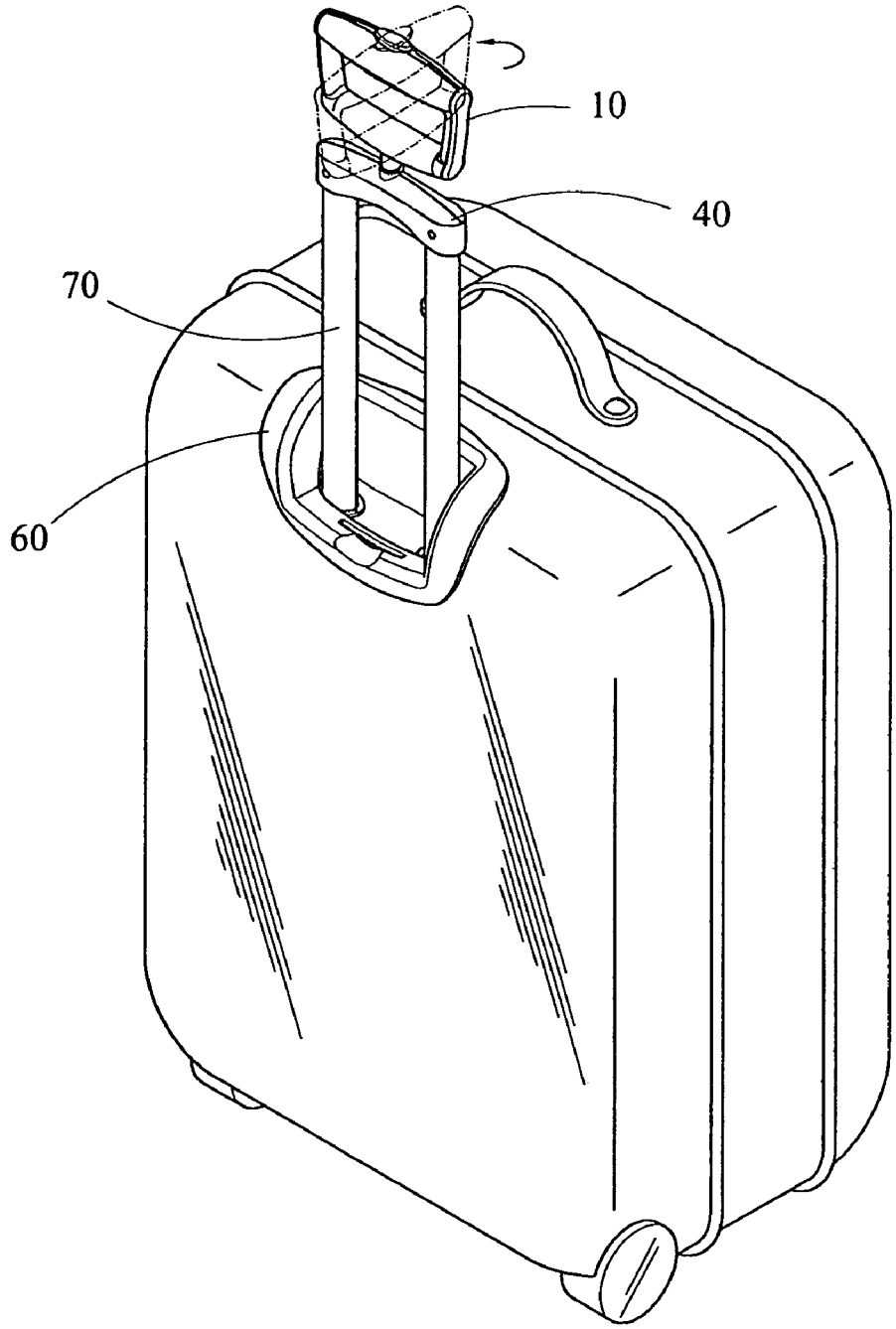
FIG. 11 is a perspective view of a wheeled luggage case incorporating the handle in FIG. 6.

On outer surface of the part 31A there are provided holes 326 and apertures 325. On inner surface of the part 31 there are provided a central half-circular top flange 311, an arcuate narrow shoulder 312 below the flange 311, an enlarged, hollow cylinder 313 below the shoulder 312, the cylinder 313 having two side flats 313A, a small cavity 314 on a bottom of the cylinder 313, two side pins 317, and a plurality of inner threaded pins 315 and 316 so that a plurality of screws 36 can be driven through the holes 326 into the inner threaded pins 316 for fastening parts 31A and 31 together. Further, a plurality of screws 37 can be driven through the holes of the container 40 and the apertures 325 into the inner threaded pins 315 for fastening the second transmission mechanism 30 in the container 40. In the assembled position, the spring 44 is anchored in the cavity 314 for pushing the seat 33 upward. The post 322 is inserted in the channel 334 (as shown in FIGS. 9 and 10). The sides of the locking member 32 are engaged with the upper portion of the two side flats 313A of the cylinder 313. The toothed member 121D is inserted into the cylinder 313 with the neck 121C in the shoulder 312 so that an upward movement of the toothed member 121D is limited by the shoulder 312, and the elongate member 320 being urged upward by seat 33 to be disposed in and locked by two opposite slots 121E.

In response to pressing the push button 14, the second transmission mechanism 30 is adapted to transmit a downward force from the upright rod 18 to lower the toothed member 121D so as to push down both the locking member 32 and the seat 33 for compressing the spring 34. Wells 353 of the levers 35 are thus pushed down by the side posts 321 for causing the levers 35 to pivot about the pins 317 for lifting the slots 351, as shown in FIG. 10. As a result, making the enlarged ends 51 of the connecting rods 50 lift to pull the other ends 52 of the connecting rods 50 for unlocking the locking devices 80. As an end, not only a sliding of the pulling rods is possible but also a swivel of the handle grip 10 is possible (see FIG. 11).

The elongate container 40 can be eliminated in other embodiment. While the invention herein disclosed has been described by means of specific embodiments, numerous modifications and variations could be made thereto by those skilled in the art without departing from the scope and spirit of the invention set forth in the claims.

What is claimed is:

1. A retractable handle of a wheeled luggage, comprising:

a pulling rod including one or more sliding tubes and a support tube; and a swivel handle grip mounted on a top of the pulling rod and comprising:

an enclosed frame including a top recessed seat, a horizontal passage, and a bottom recess; and a transmission mechanism comprising:

a push button slidably anchored in the top recessed seat, an upper sliding block disposed in the passage, a flexible connecting rod having one end fastened at the upper sliding block, a spring biased lower sliding block disposed in the bottom recess, a central sleeve extended downward from a bottom of the frame of the handle grip, the sleeve having an intermediate neck and a lower annular toothed member, an upright rod slidably received in a bore of the sleeve, a locking member engaged with toothed member of the central sleeve and a bottom of the upright rod, a spring biased upright member engaged with a bottom of the locking member, and a sheath interconnecting the sleeve and the upper sliding tube for enclosing the neck, the toothed member, the upright rod, the locking member, and the upright member;

whereby pressing the push button will push one end of the connecting rod to move to a first direction and the lower sliding block to move to a second direction opposite to the first direction so that a top end of the upright rod is pressed by the lower sliding block to cause the upright rod, the locking member, and the upright member to move down to clear the locking member from the toothed member, thereby unlocking both the handle grip and the pulling rod.

2. The retractable handle of claim 1, wherein the handle grip has a shape of rectangle.

3. The retractable handle of claim 1, further comprising a hose member sleeved on the connecting rod.

4. The retractable handle of claim 1, wherein the enclosed frame further comprises a first and second openings on a bottom of the seat, a top third opening on the seat, a bottom recess, and a bottom tunnel on the bottom recess.

5. The retractable handle of claim 4, wherein the push button further comprises a spring biased first bottom post having a slanted end passed the first opening and a second bottom post having a slanted end passed the second opening.

6. The retractable handle of claim 5, wherein the upper sliding block further comprises a first compartment, a second compartment having a slanted surface with the slanted end of the first bottom post disposed thereon, and a third compartment having a slanted surface with the slanted end of the second bottom post disposed thereon.

7. The retractable handle of claim 1, wherein the lower sliding block further comprises a left cavity with an other end of the connecting rod fastened therein and a bottom dent.

8. The retractable handle of claim 4, wherein the upright rod further comprises a sharp top end passed the bottom tunnel of the frame to urge against a dent of the lower sliding block.

9. A retractable handle of a wheeled luggage, comprising: a pair of pulling rods each including one or more sliding tubes and a support tube; and a swivel handle grip mounted on a top of the pulling rod and comprising:

an enclosed frame including a top recessed seat, a horizontal passage, and a bottom recess;

a first transmission mechanism comprising a push button slidably anchored in the top recessed seat, an upper sliding block disposed in the passage, a flexible connecting rod having one end fastened at the upper sliding block, a spring biased lower sliding block disposed in the bottom recess of the frame, a central sleeve extended downward from a bottom of the frame of the handle grip, the sleeve having an intermediate neck and a lower annular toothed member, and an upright rod slidably received in a bore of the sleeve; and a second transmission mechanism comprising a housing including a longitudinal cylinder for slidably receiving the central sleeve of the first transmission mechanism; and an activation assembly received in the housing and comprising an inverted U-shaped locking member disposed in the passageway to be engaged with the lower annular toothed member and a bottom of the upright rod, a U-shaped seat including an upper groove, a pair of levers pivotably disposed in the housing, and a pair of flexible coupling rods each having one end fastened at the one of the levers and the other end coupled to a locking device in either pulling rod, whereby pressing the push button will push one end of the connecting rod to move to a first direction and the lower sliding block to move to a second direction opposite to the first direction so that a top end of the upright rod is pressed by the lower sliding block to lower the upright rod, the locking member, and the seat for pushing down a first end of lever and lifting a second end of the lever, thereby unlocking both the handle grip and the locking devices in the pulling rods via the coupling rods.

10. The retractable handle of claim 9, wherein the handle grip has a shape of rectangle.

11. The retractable handle of claim 9, further comprising a hose member sleeved on the connecting rod.

12. The retractable handle of claim 9, further comprising a container for receiving the second transmission mechanism.

13. The retractable handle of claim 9, wherein the house further comprises a top flange, a narrow shoulder below the flange for slidably receiving the neck, a space below the shoulder for slidably receiving the toothed member, a transverse passageway through the space, and a bottom cavity.

14. The retractable handle of claim 9, wherein the locking member further comprises a lower central post and two lower side posts.

15. The retractable handle of claim 9, wherein the U-shaped seat further comprises a spring biased lower post anchored on the bottom cavity for pushing the seat upward, and a channel through the lower post with the central post disposed therein.

* * * * *